US011141981B2

(12) United States Patent
Suzuki

(10) Patent No.: US 11,141,981 B2
(45) Date of Patent: Oct. 12, 2021

(54) WASTE FLUID QUANTITY MEASURING DEVICE AND PRINTER EQUIPPED THEREWITH

(71) Applicant: Roland DG Corporation, Hamamatsu (JP)

(72) Inventor: Hironobu Suzuki, Hamamatsu (JP)

(73) Assignee: Roland DG Corporation, Hamamatsu (JP)

( * ) Notice: Subject to any disclaimer, the term of this patent is extended or adjusted under 35 U.S.C. 154(b) by 0 days.

(21) Appl. No.: 16/870,702

(22) Filed: May 8, 2020

(65) Prior Publication Data

US 2020/0361211 A1 Nov. 19, 2020

(30) Foreign Application Priority Data

May 13, 2019 (JP) ..... JP2019-90445

(51) Int. Cl.
*B41J 2/17* (2006.01)
*B41J 2/165* (2006.01)

(52) U.S. Cl.
CPC ..... *B41J 2/1721* (2013.01); *B41J 2/16532* (2013.01); *B41J 2002/1728* (2013.01)

(58) Field of Classification Search
CPC .. B41J 2/1721; B41J 2/16532; B41J 2/16523; B41J 2/16508; B41J 2002/1728; B41J 29/13; B41J 29/38; B41J 35/38; B41J 2002/1735; B41J 2002/1742; B41J 2002/1856
See application file for complete search history.

(56) References Cited

U.S. PATENT DOCUMENTS 5,657,057 A * 8/1997 Nakajima ..... B41J 2/17566 347/14
6,076,913 A * 6/2000 Garcia ..... B41J 2/16547 347/19
6,357,854 B1 * 3/2002 Igval ..... B41J 2/16523 347/29

FOREIGN PATENT DOCUMENTS

JP 2017-100362 6/2017

* cited by examiner

*Primary Examiner* — Kristal Feggins
(74) *Attorney, Agent, or Firm* — Knobbe, Martens, Olson & Bear LLP

(57) ABSTRACT

A waste fluid quantity measuring device can comprise a waste fluid tank for recovering a waste fluid, a placement platform on which the total mass of the waste fluid tank acts, a motive force portion for moving at least a portion of the placement platform from a first position to a second position, with a constant force. A sensor can measure a position of the placement platform and a measuring portion can move the placement platform and measure a movement time of the placement platform to the second position, based on a measurement result by the sensor. An evaluating portion can evaluate a state of storage of waste fluid of the waste fluid tank based on the movement time measured by the measuring portion and a correspondence of the movement time and the quantity of waste fluid within the waste fluid tank.

19 Claims, 9 Drawing Sheets

(a)

(b)

(c)

WASTE FLUID QUANTITY MEASURING DEVICE AND PRINTER EQUIPPED THEREWITH

CROSS REFERENCE TO RELATED APPLICATIONS

This application is based on and claims priority to Japanese Patent Application No. 2019-90445 filed May 13, 2019, the entire contents of which is hereby expressly incorporated by reference.

BACKGROUND OF THE INVENTIONS

Field of the Inventions

The present inventions relate to a waste fluid quantity measuring device which can be incorporated into printer or used with other devices.

Description of the Related Art

Conventionally, there are known printers that are equipped with ink heads that have a plurality of nozzles, for carrying out printing on a printed object using an ink jet method. In such printers, in order to discharge ink stably from the nozzles, cleaning operations, such as ink sucking operations for forcibly sucking out ink from within the nozzles using a suction pump, ink flushing operations for discharging the ink from within the nozzles, and the like, are carried out periodically. Nozzle blockages can be suppressed or eliminated through the cleaning operations by discharging, from the nozzles, ink that has become overly viscous, adhered substances, and the like.

In some printers, the ink and adhered substances, and the like, that is discharged in the cleaning operation is recovered into a waste fluid tank as waste fluid. Conventionally, users have performed visual checks periodically on the state of storage of waste fluid recovered in the waste fluid tank, to dispose of the waste fluid to the outside when the user feels that the waste fluid tank has become sufficiently full of waste fluid. However, when the user checks the waste fluid tank periodically, the time and effort for the check increases the burden on the user. When UV ink is used, for example, there is a problem in that cured ink can adhere to the inner surface of the waste fluid tank, causing the waste fluid tank itself to blacken and become opaque, making visual checking of the waste fluid quantity in the waste fluid tank difficult. Moreover, there have also been problems with the waste fluid overflowing and soiling the interior of the printer, and the vicinity thereof, when the waste fluid tank becomes full because the user has failed to check the waste fluid quantity.

From the point of view of reducing the problems set forth above, in some printer designs, the state of storage of waste fluid recovered into the waste fluid tank has been estimated in software, or measured in hardware. As an example of a method for estimating in software, there is a known method wherein the time of operation of the suction pump is measured, and it is inferred that the waste fluid tank has become full when a prescribed cumulative time has been reached. As an example of a method for measuring in hardware, Japanese Unexamined Patent Application Publication 2017-100362, for example, discloses that the weight of the waste fluid tank is measured using a weight sensor, and the user is prompted to replace the weight fluid tank based thereon.

SUMMARY OF THE INVENTIONS

In the method for estimating in software, as described in Japanese Unexamined Patent Application Publication 2017-100362, there have been problems with large errors from the amounts of waste fluid actually stored, due to the inability to measure waste fluid that is produced in cleaning operations wherein the suction pump is not activated, such as, for example, ink flushing operations, and due to evaporation of the waste fluid. Moreover, in the method of measurement through hardware, described above, an expensive weight sensor has been required, which tends to increase the manufacturing cost. Because of this, the ability to ascertain the state of storage of waste fluid through an entirely new concept is anticipated.

The present inventions were created in contemplation of these points, and the object of at least one of the inventions disclosed herein is to provide a waste fluid quantity measuring device able to ascertain the state of storage of waste fluid in a waste fluid tank using a new structure, and to provide a printer equipped therewith.

In some embodiments, a waste fluid quantity measuring device can comprise a waste fluid tank for recovering a waste fluid, a placement platform, having a placing portion for placement of the waste fluid tank, and on which the total mass of the waste fluid tank acts, and a motive force portion, connected to the placement platform, for moving at least a portion of the placement platform from a first position to a second position that is higher than the first position, with a constant force. A sensor can be provided for determining a position of the placement platform. A measuring portion can be provided for driving the motive force portion to move the placement platform and for measuring movement time for the placement platform moving from the first position to the second position, based on a measurement result by the sensor. A storing portion can be provided for storing a correlation between the movement time and the quantity of the waste fluid within the waste fluid tank. Additionally, an evaluating portion can be provided for evaluating a state of storage of waste fluid of the waste fluid tank from the movement time measured by the measuring portion, based on the correlation in the storing portion.

Additionally, in some embodiments, a printer can comprise an ink head having a nozzle for discharging ink, a cleaning device for carrying out a cleaning operation for discharging ink from the nozzle, and a waste fluid quantity measuring device as set forth above.

During operation of the waste fluid quantity measuring device and printer described above, the waste fluid tank is lifted to a prescribed position on a placement platform by a motive force portion, and the time required for the lifting (the lifting time) is measured. Through Newton's equations for motion, the lifting time will be proportional to the waste fluid quantity in the waste fluid tank. Consequently, in the waste fluid quantity measuring device and printer, described above, it is possible to evaluate the state of storage of waste fluid in the waste fluid tank based on the measured value for the lifting time, without the use of a costly mass sensor. The manufacturing cost can be reduced thereby. Moreover, when compared to the method for estimating in software, this can more accurately ascertain the quantity of the stored waste fluid.

Some embodiments provide a waste fluid quantity measuring device, and printer equipped therewith, that is able to ascertain the quantity of waste fluid within the waste fluid tank using a new structure.

BRIEF DESCRIPTION OF THE DRAWINGS

FIG. 7 (*b*) is an operation waveform for when the waste fluid quantity is at 50% of the storage capacity of the waste fluid tank.

FIG. 7 (*c*) is an operation waveform for when the waste fluid tank is full.

DETAILED DESCRIPTION OF THE PREFERRED EMBODIMENTS

An embodiment of an ink jet printer (hereinafter termed simply a "printer") is explained below in reference to appropriate drawings. Note the embodiments explained herein are not intended to limit the present inventions in particular. Moreover, identical reference symbols are assigned to members/positions that have identical or similar functions, and redundant explanations are omitted or simplified as appropriate. Moreover, in this Specification, "ink jet printer" refers to printers in general that use a conventional known printing method using an ink jet technology, for example, a continuous method such as the binary deflection method or continuous deflection method, or any of a variety of on-demand methods, such as the piezoelectric element method.

Figure 1:
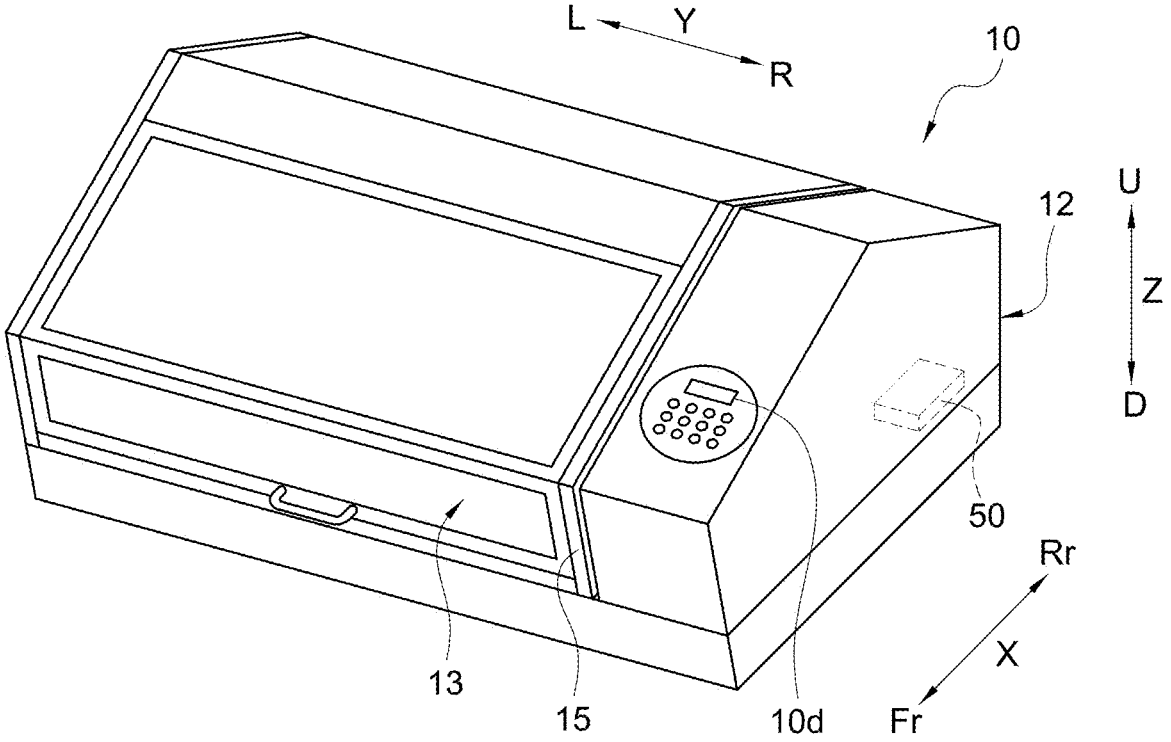
FIG. 1 is a perspective diagram of an ink jet printer according to an embodiment.
Figure 2:
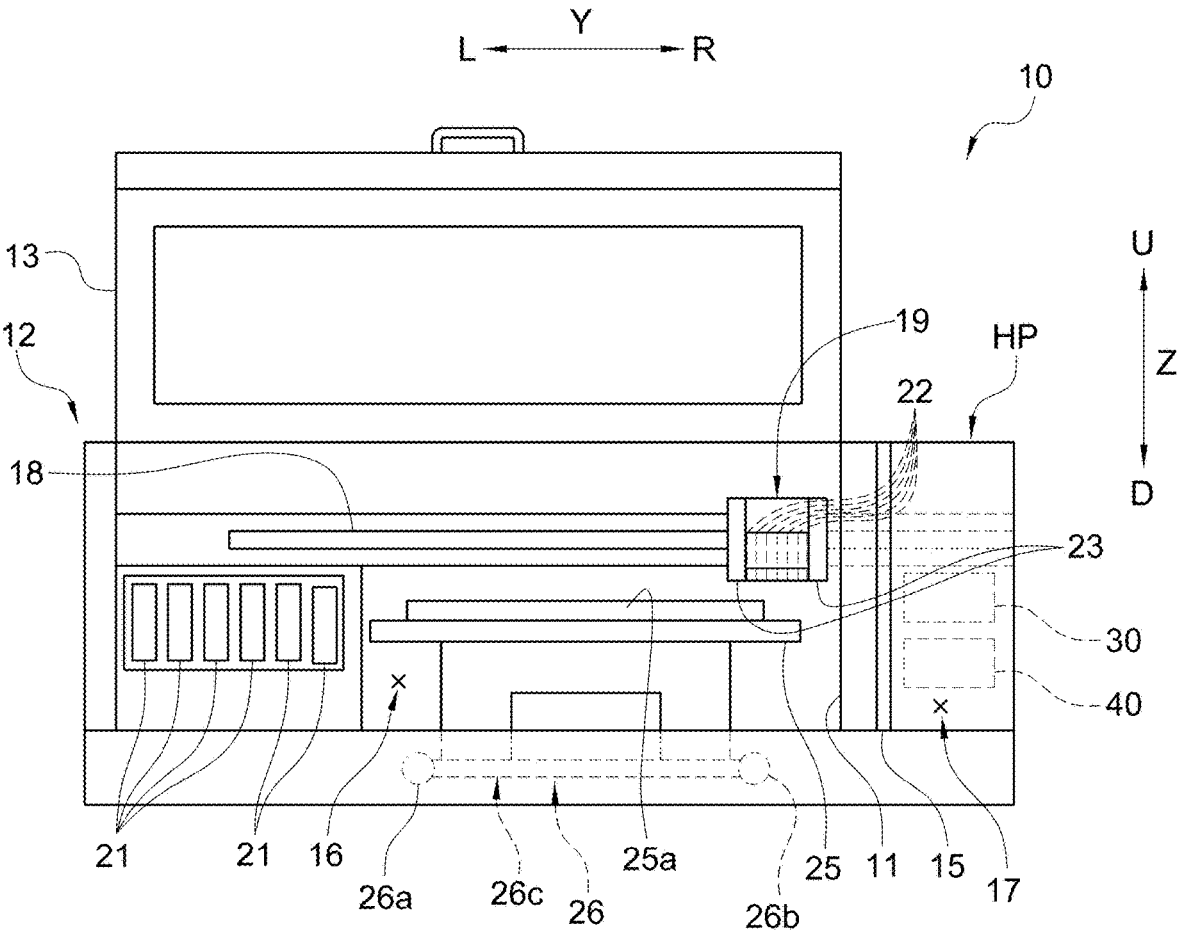
FIG. 2 is a front view of an ink jet printer with a cleaning apparatus according to an embodiment.

FIG. 1 is a perspective diagram of a printer 10. FIG. 2 is a front view of the state wherein the front cover 13 of the printer 10 is open. In the explanation below, left, right, up, and down have the respective meanings of left, right, up, and down when viewed by a user (the user of the printer 10) that is in front of the printer 10, where the direction from the printer 10 toward the user is termed "forward" and away from the user is termed "rearward." Moreover, in the drawings, the reference symbols Fr, Rr, L, R, U, and D indicate, respectively, front, rear, left, right, up, and down. The reference symbols X, Y, and Z in the drawings indicate, respectively, the front/rear direction, the crosswise direction, and the vertical direction. Note that these directions are identified for convenience in explanations, and in no way limit the inventions embodied by the printer 10.

The printer 10 is a device for receiving print data from an external device, such as, for example, a host computer, and for printing an image onto a printed object 25*a* based on the print data. There is no particular limitation on the shape or material of the printed object 25*a*. The material for the printed object 25*a* can be, of course, a type of paper such as ordinary paper, ink jet printing paper, or the like, or, for example, can be any of the following: a resin material such as polyvinyl chloride, acrylic, polycarbonate, polyester, polystyrene, an acrylonitrile-butadiene-styrene (ABS) copolymer, or the like; a fabric such as a woven fabric or a nonwoven fabric, or the like; leather; a metal such as aluminum, stainless steel, or the like; carbon; earthenware; ceramic; glass; rubber, or the like. Moreover, in this Specification, "image" is an image that is formed on the printed object 25*a*, and there is no particular limitation to the detail thereof. Text, numbers, symbols, graphics, designs, patterns, and the like, are covered by the term "image."

As illustrated in FIG. 1, the printer 10 is formed in the shape of a box that extends in the crosswise direction Y. As illustrated in FIG. 2, the printer 10 comprises a casing 12 that has an opening 11, and an openable and closeable front cover 13 that covers the opening 11. The front cover 13 is supported on the top face of the casing 12 so as to be able to rotate with the back end thereof as the axis. Opening the front cover 13 around the back end as the axis, the space within the casing 12 communicates with the outside space. The space in the interior of the casing 12 is partitioned into a first area 16 and a second area 17 in the crosswise direction Y through a partitioning member 15 that extends in the vertical direction Z. The first area 16 is a space that is positioned on the left side of the partitioning member 15. Printing onto the printed object 25*a* is carried out in the first area 16. The second area 17 is a space that is positioned to the right side of the partitioning member 15.

Figure 6:
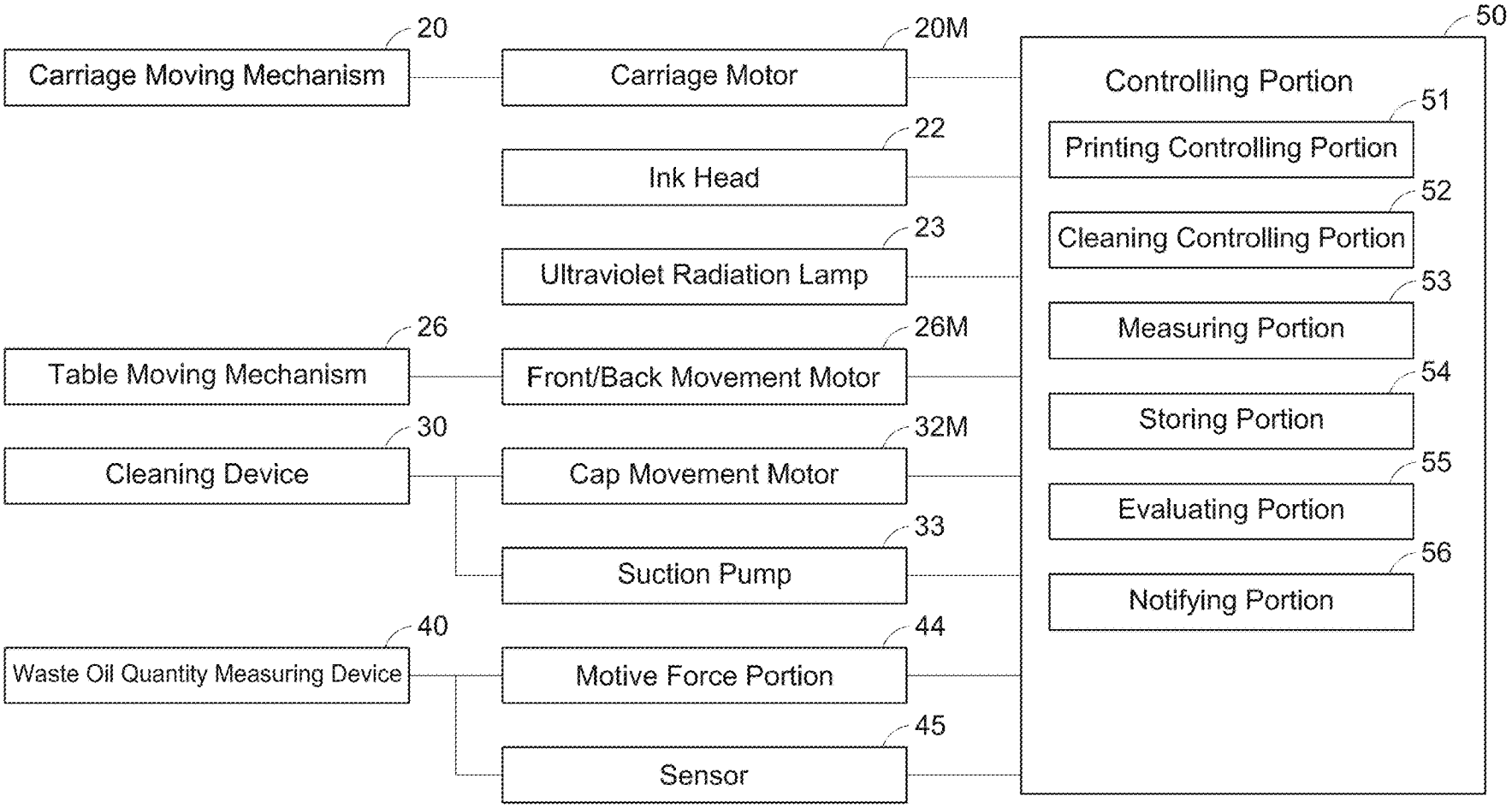
FIG. 6 is a functional block diagram depicting the structure of the controlling portion.

As illustrated in FIG. 2, the printer 10 comprises a guide rail 18, a carriage 19, a carriage moving mechanism (or "carriage drive mechanism") 20 (referencing FIG. 6), ink heads 22, ink cartridges 21, an ultraviolet radiation lamp 23, a table 25, a table moving mechanism (or "table drive mechanism") 26, a cleaning device 30, a waste fluid quantity measuring device 40, and a controlling portion (or "controller") 50 (referencing FIGS. 1 and 6). In the present embodiment, the ink cartridges 21 and the table 25 are disposed in the first area 16. The cleaning device 30 and the waste fluid quantity measuring device 40 are disposed to the front of the second area 17. The controlling portion 50 is disposed to the rear of the second area 17. Each of these structural elements are explained below.

As illustrated in FIG. 2, the guide rail 18 is provided above the table 25. The guide rail 18 is secured to the casing 12, and extends in the crosswise direction Y across the first area 16 and the second area 17. The carriage 19 is equipped slidably on the guide rail 18. The guide rail 18 guides the movement of the carriage 19 in the crosswise direction Y. The carriage 19 is structured (or "configured") so as to be able to move in the crosswise direction (the primary scanning direction) Y through the carriage moving mechanism 20 (referencing FIG. 6). When printing is not in progress, the carriage 19 stands by at the location of a home position HP.

The carriage moving mechanism 20 is structured so as to move the carriage 19 in the crosswise direction Y relative to the table 25. The carriage moving mechanism 20 can comprise a pair of pulleys (not shown) that are located at the right end and the left end of the guide rail 18, a looped belt (not shown), and a carriage motor 20M (referencing FIG. 6). The carriage 19 is secured to the looped belt. The looped belt is wrapped around the pair of pulleys. One of the pulleys is coupled to the carriage motor 20M. The carriage motor 20M is connected electrically to a controlling portion 50, and is controlled by the controlling portion 50. When the carriage motor 20M is driven, the pulley rotates so that the belt travels. Through this, the carriage 19 is moved in the crosswise direction Y along the guide rail 18. Note that the mechanism explained here is an example of a mechanism that can be used, and places no particular limitation on the structure of the carriage moving mechanism 20. Other configurations of the mechanism 20 or other mechanisms can also be used.

As illustrated in FIG. 2, six ink heads 22 and two ultraviolet radiation lamps 23 are mounted on the carriage 19. Thus, the printer 10 can be considered to be an ultraviolet radiation curable printer. As illustrated in FIG. 2, in some embodiments, the six ink heads 22 are arranged in a so-called "in-line" layout. The six ink heads 22 are lined up in the crosswise direction Y. However, there is no particular limitation on the arrangement of the ink heads 22. The ink head 22 has a nozzle 22*a* (referencing FIG. 3) that is open downward. The ink head 22 is configured so as to discharge ink toward the printed object 25*a* from the nozzle 22*a* during printing. The ink head 22 is connected electrically to the controlling portion 50. The discharge of ink from the nozzle 22*a* is controlled by the controlling portion 50. Each ink head 22 is connected to a respective ink cartridge 21 through a flexible ink tube (not shown).

The ink cartridges 21 are containers for storing ink. As illustrated in FIG. 2, the ink cartridges 21 are not mounted on the carriage 19, but rather are stationary in the first area 16 of the casing 12. An ink of a type that is curable optically (a photocurable ink) that includes a polymerizable compound and a polymerization initiator, is stored in each of the ink cartridges 21. The photocurable ink here is an ultraviolet radiation curable ink (UV ink) that is cured through exposure to ultraviolet radiation. Here the number of ink cartridges 21 is six. The six ink cartridges 21 store, respectively, cyan ink (C), magenta ink (M), yellow ink (Y), black ink (K), white ink (WH), and gloss ink (GL). Note that while, in the present embodiment, there are six ink cartridges 21, this is merely an example of the number of ink cartridges 21 in the types of inks, and there is no particular limitation thereto. Other numbers of ink cartridges can also be used.

The ultraviolet radiation lamp 23 is a light-emitting device for curing the ink on the printed object 25*a*. As illustrated in FIG. 2, in the present embodiment ultraviolet radiation lamps 23 are disposed one each on both the left and right ends of the ink head 22. The light emitted from the ultraviolet radiation lamps 23 has an ultraviolet radiation wavelength that is able to cure the ink. The ultraviolet radiation lamp 23 can be, for example, an LED (Light-Emitting Diode), a fluorescent lamp (low-pressure mercury lamp), a high-pressure mercury lamp, or the like. The ultraviolet radiation lamp 23 is connected electrically to the controlling portion 50, and is controlled by the controlling portion 50. Note that while in the present embodiment the number of ultraviolet radiation lamps 23 is two, this is no more than an example of the number of ultraviolet radiation lamps 23, and there is no particular limitation thereto. Other numbers of lamps can also be used. The ultraviolet radiation lamp 23 can be disposed instead on only the left end or right end of the ink head 22 alone. Moreover, the ultraviolet radiation lamp 23 can instead be mounted on a carriage that is separate from that of the ink head 22, or can be installed directly or indirectly on the surface of a wall of the casing 12, or the like.

The table 25 is a platform for placement of the printed object 25*a* during printing. As illustrated in FIG. 2, the table 25 is disposed below the carriage 19. The table 25 is a flat plate-shaped member, and has a flat upper support surface, when viewed from the front. Thus, the printer 10 can be considered to be a so-called "flatbed" printer. The table 25 is structured so as to be able to move in the front/rear direction X through the table moving mechanism 26.

The table moving mechanism 26 is structured so as to move the table 25 in the front/rear direction X relative to the carriage 19. The table moving mechanism 26 comprises two slide rails 26*a* and 26*b*, a feeding member 26*c*, and a front/rear movement motor 26M (referencing FIG. 6). The slide rails 26*a* and 26*b* extend in parallel along the front/rear direction X. The feeding member 26*c* is provided slidably in respect to the slide rails 26*a* and 26*b*. The table 25 is supported above the feeding member 26*c*. The front/rear movement motor 26M is connected electrically to the controlling portion 50, and is controlled by the controlling portion 50. When the front/rear movement motor 26M is driven, the feeding member 26*c* moves along the slide rails 26*a* and 26*b*. The table 25 moves in the front/rear direction X. Note that the mechanism explained here is no more than an example, and the structure of the table moving mechanism 26 is not limited in particular thereto. Other structures can also be used.

The cleaning device 30 is structured so as to remove adhered substance (for example, dust, thickened ink, hardened materials, contamination, and the like) that is adhered to the nozzles 22*a* of the ink head 22. The cleaning device 30 is located directly below the carriage 19 when the carriage 19 is located at the home position HP (referencing FIG. 2).

Figure 3:
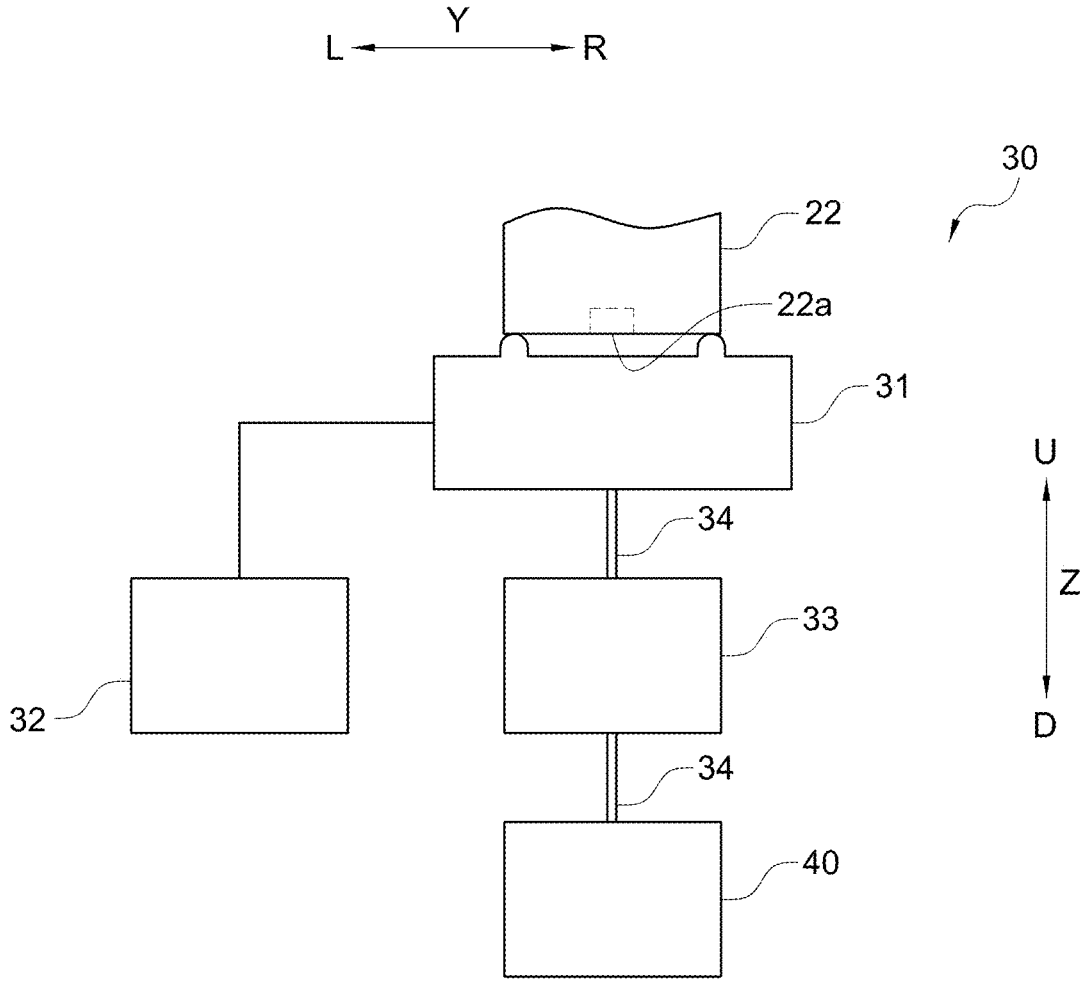
FIG. 3 is a schematic diagram depicting the structure of the cleaning apparatus in FIG. 2.

FIG. 3 is a schematic diagram showing the structure of the cleaning device 30. The cleaning device 30 comprises a cap 31, a cap moving mechanism (or "cap drive mechanism") 32, a suction pump 33, and a waste fluid duct 34. In the present embodiment, a cleaning device 30 is provided for each ink head 22. However, in several configurations, it can instead be shared by a plurality of ink heads 22. For example, there can be a shared (single) cap moving mechanism 32 and/or suction pump 33 for a plurality of (for example, 2) ink heads 22.

The cap 31 is configured so as to cover the periphery of a nozzle 22*a* of an ink head 22. In the present embodiment, a cap 31 is provided for each individual ink head 22. At the home position HP (referencing FIG. 2), the caps 31 are positioned directly below the respectively corresponding ink heads 22. Although there is no particular limitation thereto, the cap 31 has a closed-bottom box shape that is open at the top. The caps 31 are connected to the cap moving mechanism 32. The caps 31 are placed removably onto the nozzles 22*a* of the ink heads 22 by the cap moving mechanism 32.

The cap moving mechanism 32 can be a mechanism that is structured or "configured" to place the caps 31 onto the nozzles 22*a* of the ink heads 22, and to remove the caps 31 from the nozzles 22*a* of the ink heads 22. The cap moving mechanism 32 here can be a mechanism that supports and moves the caps 31, to raise and lower the caps 31 in the vertical direction Z. The cap moving mechanism 32 can comprise a cap movement motor 32M (referencing FIG. 6). The cap movement motor 32M is connected electrically to the controlling portion 50, and controlled by the controlling portion 50. When the cap movement motor 32M is driven, the caps 31 move relative to the ink heads 22, to move to a capping position wherein the nozzles 22*a* are covered, or to a separated position wherein they are spaced away from the nozzles 22*a*. FIG. 3 shows the state wherein the cap 31 is at the capped position, that is, the state wherein the cap 31 is placed onto the nozzle 22*a*. Note that the mechanism described here is no more than an example, and the structure of the cap moving mechanism 32 is not particularly limited thereto.

The waste fluid duct 34 can define a flow path that directs the waste fluid from the cap 31 to the waste fluid quantity measuring device 40, described below. The waste fluid duct 34 is structured from, for example, a flexible tube, or the like. A suction pump 33 is provided part way through on the waste fluid duct 34. The suction pump 33 is connected to the bottom face of the cap 31. The suction pump 33 sucks the ink, and the like, from the nozzle 22*a* in a state wherein the cap 31 is placed on the nozzle 22*a*. The suction pump 33 conveys the ink, and the like, that accumulates in the cap 31 to the waste fluid quantity measuring device 40. While there is no particular limitation thereto, the suction pump 33 is, for example, a vacuum pump. Other types of pumps can also be used. The suction pump 33 is connected electrically to the controlling portion 50, and controlled by the controlling portion 50.

During cleaning of a nozzle 22*a* of an ink head 22, when the suction pump 33 is driven in a state wherein the cap 31 is applied to the nozzle 22*a*, the ink, adhered substance, and the like is drawn out from the nozzle 22*a* through the cap 31, to accumulate in the cap 31. When the ink head 22 is driven in a state wherein the cap 31 is placed on the nozzle 22*a*, the ink and adhered substances are discharged into the cap 31, to accumulate within the cap 31. The cap 31 is connected through the waste fluid duct 34 to the waste fluid quantity measuring device 40. The ink, adhered substances, and the like, that have accumulated in the cap 31 are fed as waste fluid through the waste fluid duct 34 to the waste fluid quantity measuring device 40.

Figure 4:
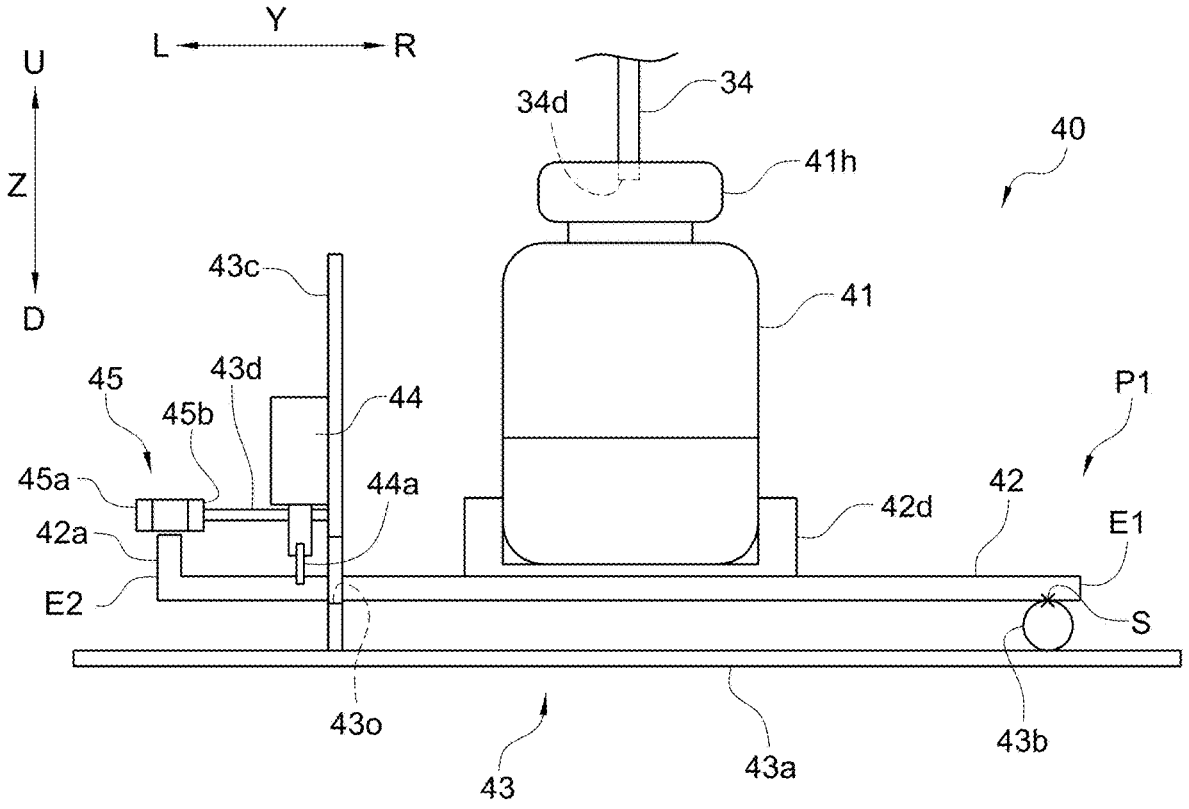
FIG. 4 is a side view of a waste fluid quantity measuring device in the state wherein a placement platform is at a home position P1.
Figure 5:
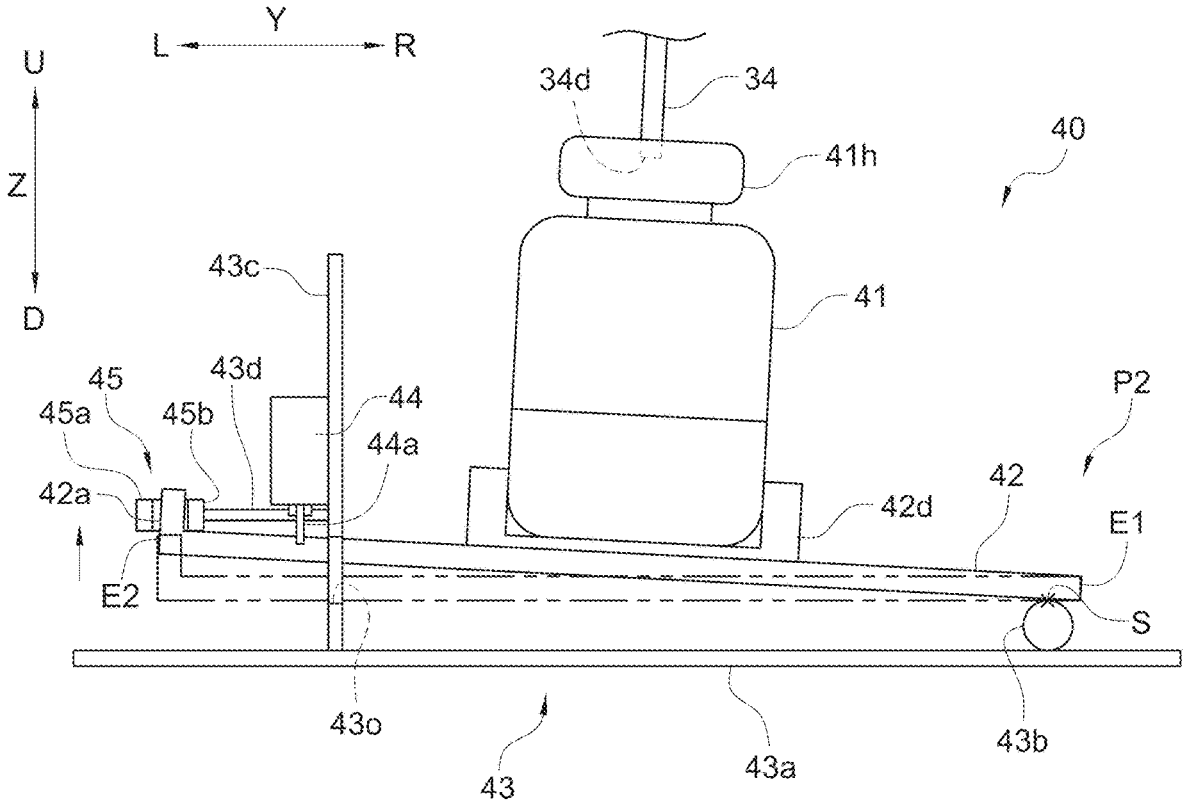
FIG. 5 is a side view of a waste fluid quantity measuring device wherein the placement platform is at a tilted position P2.

The waste fluid quantity measuring device 40 recovers the waste fluid that is produced during cleaning operations, and the like, and also measures the quantity of the waste fluid that has been recovered. As illustrated in FIG. 2, the waste fluid quantity measuring device 40 is disposed below the cleaning device 30 at the location of the home position HP. FIG. 4 and FIG. 5 are side views of the waste fluid quantity measuring device 40. The waste fluid quantity measuring device 40 comprises a waste fluid tank 41, a placement platform 42, a supporting portion 43, a motive force portion 44, and a sensor 45. Note that FIG. 4 shows a state wherein the placement platform 42 is at a "home position P1," which can be substantially horizontal, and FIG. 5 shows a state wherein the placement platform 42 is at a "tilted position P2," that is at more of an incline than the home position P1. The home position P1 is an example of the first position, and the tilted position P2 is an example of the second position. Moreover, in the present Specification, "substantially horizontal" need not necessarily be strictly horizontal, but rather is a term that includes cases wherein the angle of inclination in respect to the horizontal direction is no more than about 15°, or no more than 10°, or no more than 5°.

The waste fluid tank 41 is a container for recovery and storage of waste fluid of ink (waste ink) that was not used in printing. As illustrated in FIG. 4, the waste fluid tank 41 is placed on the placement platform 42. In the present embodiment, the waste fluid tank 41 has a round cylindrical shape. However, there is no particular limitation to the shape of the waste fluid tank 41. The waste fluid tank 41 can instead be, for example, a cube shape, a parallelepiped shape, or the like. The waste fluid tank 41 can have a cylindrical neck 41*h*. The neck 41*h* is open at the top. The bottom end 34*d* of the waste fluid duct 34 is inserted into the neck 41*h*. The bottom end 34*d* of the waste fluid duct 34 is positioned below the top face of the waste fluid tank 41.

The waste fluid tank 41 is made, for example, from a resin such as polyethylene, polypropylene, silicone, a fluorine-based resin, or the like. The waste fluid tank 41 can be black and opaque. In the present embodiment, the waste fluid tank 41 is disposed in the interior of the printer 10. The printer 10 uses UV ink, and thus cured ink can adhere to the inner surface of the waste fluid tank 41, and the waste fluid tank 41 itself can be blackened and opaque. In such a case, it would be difficult for the user to check visually the quantity of waste fluid recovered in the waste fluid tank 41. Consequently, the application of the technology disclosed herein would be more effective. However, in another embodiment the waste fluid tank 41 can be disposed in a space outside of the printer 10.

The placement platform 42 is a placement platform for placement of the waste fluid tank 41. The placement platform 42 can be formed in a rectangular flat plate shape. The placement platform 42 extends along the bottom face of the second area 17 of the casing 12 (referencing FIG. 2). As illustrated in FIG. 4, a tray 42*d* is secured to the surface of the placement platform 42. The tray 42*d* functions as a guide indicating to the user the position for placing the waste fluid tank 41. The tray 42*d* is an example of a placement portion. Other structures or configurations can also be used. The tray 42*d* can also be structured container or spill control trough for receiving the waste fluid if the waste fluid were to overflow from the waste fluid tank 41, or if waste fluid were to be splashed from the waste fluid tank 41 accidentally. The total mass of the waste fluid tank 41 (the total mass that is the mass of the waste fluid tank 41 itself together with the mass of the waste fluid) acts on the placement platform 42 through the tray 42*d*. The placement platform 42 is supported on the supporting portion 43 tiltably. The placement platform 42 is of a movable type. The placement platform 42 is moved by the motive force portion 44 from the home position P1, depicted in FIG. 4, to the tilted position P2, depicted in FIG. 5.

The placement portion 42 has a detected portion 42*a*. The detected portion 42*a* is a part wherein a portion of the placement platform 42 is bent upward so as to extend upwardly. Note that the detected portion 42*a* can instead be a separate member that is attached to the placement platform 42, to always move together with the placement platform 42, rather than being a portion of the placement platform 42. As illustrated in FIG. 4, the detected portion 42*a* will be at a position away from the sensor 45, and specifically positioned below the sensor 45, when the placement platform 42 is at the home position P1. The home position P1 is an "UNHIT" position wherein the detected portion 42*a* is not detected by the sensor 45. The detected portion 42*a* is moved upward accompanying tilting of the placement platform 42. The relative position of the detected portion 42*a* in respect to the sensor 45 is changed thereby. As illustrated in FIG. 5, when the placement platform 42 is moved to the tilted position P2, the detected portion 42*a* approaches the sensor 45. The tilted position P2 is a "HIT" position wherein the detected portion 42*a* is detected by the sensor 45.

The supporting portion 43 is a supporting member for supporting the placement platform 42 in the vertical direction Z tiltably. The supporting portion 43 comprises a bottom wall 43*a*, a fulcrum member 43*b*, and a side wall 43*c*. The bottom wall 43*a* is positioned directly under the placement platform 42. The bottom wall 43*a* extends in the crosswise direction Y along the bottom face of the second area 17 of the casing 12 (referencing FIG. 2). The fulcrum member 43*b* is positioned between the top face of the bottom wall 43*a* and the bottom face of the placement platform 42. The fulcrum member 43*b* contacts the bottom wall 43*a* and the placement platform 42. The fulcrum member 43*b* extends along the bottom face of the placement platform 42.

The fulcrum member 43*b* extends in the front/rear direction X (the first direction). The front/rear direction X is an example of a direction of extension of the fulcrum member 43*b*. The fulcrum member 43*b* is of a circular column shape. The fulcrum member 43*b* is positioned directly under the placement platform 42, and supports the right-hand portion of the placement platform 42. The placement platform 42 tilts with the point S of contact of the fulcrum member 43*b* with the placement platform 42 as the tilting fulcrum.

The side wall 43*c* extends, from the bottom wall 43*a*, in the upward and front/rear direction X. The side wall 43*c* is located so as to be along the partitioning member 15 (referencing FIG. 2). The side wall 43*c* is an example of a vertical wall. As illustrated in FIG. 4, the side wall 43*c* is positioned to be at a distance that is farther, in the crosswise direction Y (the second direction), from the tilting fulcrum S than the waste fluid tank 41 and the tray 42*d*. The end portion on the side of the placement platform 42 that is relatively near, in the crosswise direction Y (second direction), to the fulcrum member 43*b* is defined as E1 and the end portion of the placement platform 42 that is on the side that is relatively far from the fulcrum member 43*b* is defined as the other end E2. In this optional configuration, the side wall 43*c* is disposed nearer to the other end E2 than the one end E1. A receiving hole 43*o* is formed in the side wall 43*c*. The placement platform 42 is fitted tiltably into the receiving hole 43*o*. The side wall 43*c* supports the left-hand portion of the placement platform 42 through the receiving hole 43*o*.

In the present embodiment, the range of tilting of the placement platform 42 is constrained by the size of the receiving hole 43*o*, and, specifically, by the length thereof in the vertical direction Z. Because of this, even if, for example, the user were to accidentally strike the placement platform 42, the waste fluid tank 41 would be held stably, without the placement platform 42 tilting excessively. When the placement platform 42 is in the home position P1, the bottom face of the placement platform 42 contacts the bottom end of the receiving hole 43*o*. Through this, the placement platform 42 is supported by the fulcrum member 43*b* and the bottom end of the receiving hole 43*o*. The placement platform 42 rests in a substantially horizontal orientation. On the other hand, when the placement platform 42 is moved to the tilted position P2 through the motive force portion 44, the top face of the placement platform 42 will contact the top end of the receiving hole 43*o*. The placement platform 42 uses the point S as the tilting fulcrum, and assumes an orientation that is tilted toward the right, with the left end positioned higher than the right end. In the tilted position P2, the angle with the first position P1 can be an acute angle of no more than about 45°, and typically can be no more than 30°, or can be, for example, no more than 15°.

The motive force portion 44 is a member for moving at least a portion of the placement platform 42 upward when checking the state of storage of waste fluid in the waste fluid tank 41. In the present embodiment, the motive force portion 44 is a member that tilts the placement platform 42 through the "principle of leverage." More specifically, it is a member that lifts the placement platform 42 with a constant force F upward, causing the placement platform 42 to move away from the bottom end of the receiving hole 43*o*. As illustrated in FIG. 4, the motive force portion 44 can be attached to the side wall 43*c*. Note that the motive force portion 44 can instead be attached, for example, to the bottom wall 43*a*, the partitioning member 15, or the like. The motive force portion 44 is connected to the placement platform 42 through a connecting portion 44*a*. As illustrated in FIG. 4, the connecting portion 44*a* is farther, in the crosswise direction Y (the second direction), from the tilting fulcrum S than the waste fluid tank 41 and the tray 42*d*. The connecting portion 44*a* is located on the side of the placement platform 42 that is nearer to the other end E2 than the one end E1 in the crosswise direction Y (the second direction). This enables the placement platform 42 to be lifted upwardly, stably. Additionally, at least a portion of the placement platform 42 can be moved effectively upwardly.

The motive force portion 44 is structured to generate a force sufficient to lift the placement platform 42 upwardly, even when the waste fluid tank 41 is in a full state. The motive force portion 44 can be, for example, a solenoid. The motive force portion 44 can be, for example, a motor instead. Other types of actuators can also be used. The motive force portion 44 is connected electrically to the controlling portion 50, and controlled by the controlling portion 50. The motive force portion 44 is configured to lift the placement platform 42 upwardly with a constant force F through controlling the current that flows in the solenoid to a constant current. In some embodiments, the height to which the placement platform 42 is lifted is only about several millimeters, no more than about 10 mm, or no more than 5 mm, and, for example, can be between 1 and 2 mm. That is, the position of the other end E2 of the placement platform 42 at the tilted position P2 is about only a few millimeters higher than the position of the other end E2 of the placement platform 42 at the home position P1, no more than about 10 mm, or no more than 5 mm, and can be, for example, a position that is between 1 and 2 mm higher.

The sensor 45 can be structured to measure or detect the position of the placement platform 42 when checking the state of storage of the waste fluid in the waste fluid tank 41. In some embodiments, the sensor 45 is a member that detects, by detecting the presence of the detected portion 42*a*, that the placement platform 42 has moved from the home position P1 to the tilted position P2. Note that the sensor 45 can be structured to measure the movement of the placement platform 42 directly instead. As illustrated in FIG. 4, the sensor 45 is attached to a horizontal arm portion 43*d* that extends to the left from the side wall 43*c*. The sensor 45 is attached to the same member as the motive force portion 44, that is, to the side wall 43*c*. Note that the sensor 45 can be attached to a member that is different from that of the motive force portion 44 instead. The sensor 45 can, for example, be attached to the bottom wall 43*a* or the partitioning member 15, or the like, instead.

As illustrated in FIG. 4, the sensor 45 is farther, in the crosswise direction Y (the second direction), from the tilting fulcrum S than the waste fluid tank 41 and the tray 42*d*. The sensor 45 is positioned on the side that is nearer, in the crosswise direction Y (the second direction), to the other end E2 than the one end E1 of the placement platform 42. The sensor 45 is farther from the tilting fulcrum S than the connecting portion 44*a*. The sensor 45 is located on the side that is nearer to the other end E2 than the connecting portion 44*a*. The other end E2 of the placement platform 42 moves, in the vertical direction Z, more than the one end E1. Because of this, when compared to the case wherein the sensor 45 is located near to the one end E1, for example, the change in position of the placement platform 42 can be better detected.

That which is well known can be used for the sensor 45. The sensor 45 is, for example, a photosensor. Because a photosensor has a fast response time, it can measure the movement of the detected portion 42*a* more accurately. In the present embodiment, the sensor 45 is a transmissive photosensor. The sensor 45 comprises a light-emitting portion 45*a* and a photodetecting portion 45*b*. The light-emitting portion 45*a* and the photodetecting portion 45*b* are disposed facing each other in the crosswise direction Y. A gap is provided between the light-emitting portion 45*a* and the photodetecting portion 45*b* so that the detected portion 42*a* can be interposed therebetween. In the sensor 45, light is emitted from the light-emitting portion 45*a* toward the photodetecting portion 45*b*. The sensor 45 is connected electrically to the controlling portion 50, and is controlled by the controlling portion 50. As such, the sensor 45 outputs a signal to the controlling portion 50, indicative of the movement of the detected portion 42*a*.

As illustrated in FIG. 4, when the placement platform 42 is in the home position P1, the light that is emitted from the light-emitting portion 45*a* is directed to the photodetecting portion 45*b*, without being blocked by the detected portion 42*a*. The sensor 45 will be in the "UNHIT" state wherein the detected portion 42*a* is not detected. On the other hand, as illustrated in FIG. 5, when the placement platform 42 is moved to the tilted position P2, the detected portion 42*a* is interposed between the light-emitting portion 45*a* and the photodetecting portion 45*b*. Through this, the light that is directed from the light-emitting portion 45*a* to the photodetecting portion 45*b* is blocked. The magnitude of the light detected by the photodetecting portion 45*b* (the detected brightness) is reduced. The sensor 45 goes into the "HIT" state wherein the detected portion 42*a* is detected. The value of the detected brightness is inputted from the photodetecting portion 45*b* into the controlling portion 50 (referencing FIG. 6). In the controlling portion 50, the movement of the placement platform 42 to the tilted position P2 is detected based on the value for this amount to which the light is blocked.

The controlling portion 50 controls the operations of each of the portions of the printer 10. In some embodiments, the controlling portion 50 is a computer that is dedicated to the printer 10, disposed within the casing 12. The controlling portion 50 is, for example, a microcomputer. Note that the controlling portion 50 can instead be, for example, a general-use personal computer that is located outside of the casing 12, and that is connected so as to be able to communicate with the printer 10, either through a cable or wirelessly.

There is no particular limitation to the hardware structure of the controlling portion 50. The controlling portion 50 comprises, for example, an interface (I/F) for receiving print data from an external device such as a host computer, or the like, a central calculation processing device (CPU: Central Processing Unit) for executing commands of a control program, a ROM (Read-Only Memory) for storing the program to be executed by the CPU, a RAM (Random Access Memory) that is used as a working area for deploying the program, and a storing device, such as memory, or the like, for storing the program and various types of data.

FIG. 6 is a functional block diagram for the controlling portion 50. As illustrated in FIG. 6, the controlling portion 50 comprises a printing controlling portion 51, a cleaning controlling portion 52, a measuring portion 53, a storing portion 54, an evaluating portion 55, and a notifying portion 56. The various portions of the controlling portion 50 are structured so as to enable mutual communication therebetween. Each of the portions of the controlling portion 50 can be structured through software, or can be structured through hardware instead. Each of the portions of the controlling portion 50 can be achieved through one or more processors, and can be assembled together into circuitry. The controlling portion 50 is connected, to enable communications therewith, to the carriage motor 20M of the carriage moving mechanism 20, the ink head 22, the ultraviolet radiation lamp 23, the front/rear movement motor 26M of the table moving mechanism 26, the cap movement motor 32M and suction pump 33 of the cleaning device 30, and the motive force portion 44 and sensor 45 of the waste fluid quantity measuring device 40, and is structured so as to control these portions.

The printing controlling portion 51 is a controlling portion for executing printing operations for printing an image onto the printed object 25*a* on the table 25 based on the print data. The printing controlling portion 51 controls the carriage motor 20M of the carriage moving mechanism 20 to move the carriage 19 in the crosswise direction Y, and also controls the front/rear movement motor 26M of the table moving mechanism 26, to move the table 25 in the front/rear direction X. Through this, the relative positional relationship between the printed object 25*a* and the ink head 22 is controlled. The printing controlling portion 51 controls the ink head 22 to discharge ink from the nozzle 22*a* toward the printed object 25*a*. The printing controlling portion 51 controls the ultraviolet radiation lamp 23 to emit light toward the ink on the printed object 25*a* after the ink has been discharged from the nozzle 22*a* toward the printed object 25*a*.

The cleaning controlling portion 52 is a controlling portion for executing the cleaning operation to cause ink to be discharged stably from the nozzles 22*a* of the ink heads 22. The cleaning controlling portion 52 can be structured so as to execute a prescribed cleaning operation periodically. The cleaning controlling portion 52 can instead be structured so as to execute the cleaning operation upon receiving an instruction from the user when, for example, the user identifies that printing defects have occurred. The cleaning controlling portion 52 is structured so as to enable execution of, for example, an ink sucking operation and/or an ink flushing operation.

In the example of an ink sucking operation, the cleaning controlling portion 52 drives the cap movement motor 32M of the cleaning device 30 to cause the cap 31 to be placed on the nozzle 22*a* of the ink head 22. In a state wherein the cap 31 is placed on the nozzle 22*a*, the cleaning controlling portion 52 controls the suction pump 33 to suck ink from the nozzle 22*a*, to discharge the ink into the cap 31. In the example of an ink flushing operation, the cleaning controlling portion 52 drives the cap movement motor 32M of the cleaning device 30 to place the cap 31 on the nozzle 22*a* of the ink head 22. In a state wherein the cap 31 is placed on the nozzle 22*a*, the cleaning controlling portion 52 controls the ink head 22 to cause ink to be discharged from the nozzle 22*a* toward the cap 31.

The measuring portion 53 is a controlling portion for executing a measuring operation for lifting the waste fluid tank 41 together with the placement platform 42 when checking the state of storage of waste fluid in the waste fluid tank 41. The measuring portion 53 can additionally or alternatively be structured so as to execute the measuring operation continuously after execution of the cleaning operation. The measuring portion 53 can additionally or alternatively be structured so as to execute the measuring operation periodically at prescribed time intervals that are established in advance. The prescribed time interval can be set in advance in the storing portion 54. The measuring portion 53 can additionally or alternatively be structured so as to execute the measuring operation upon reception of an instruction from the user.

The measuring portion 53 drives the motive force portion 44 of the waste fluid quantity measuring device 40 to tilt the placement platform 42 with the point S as the tilting fulcrum, and also causes light to be emitted from the light-emitting portion 45*a* of the sensor 45. The measuring portion 53 receives the value of the detected brightness from the photodetecting portion 45*b* of the sensor 45. The measuring portion 53 evaluates that the sensor 45 is in the "HIT" state when the detected brightness of the photodetecting portion 45*b* is at or below a reference value that is set in advance. The measuring portion 53 measures the time (lifting time) Δt from the start of driving of the motive force portion 44 until the sensor 45 is evaluated as being in the "HIT" state. When the sensor 45 is evaluated as being in the "HIT" state, the measuring portion 53 stops driving the motive force portion 44. Through this, the placement platform 42 is returned to the home position P1 by gravity.

The storing portion 54 stores, in advance, a correspondence between the quantity of waste fluid and the lifting time Δt. In some embodiments, an equation relating the waste fluid quantity and the lifting time Δt is stored in the storing portion 54. The evaluating portion 55 substitutes the lifting time Δt that was measured by the measuring portion 53 into the relationship formula, to calculate the quantity of waste fluid in the waste fluid tank 41. The relationship formula is an example of a predefined correspondence (or "correlation") between the waste fluid quantity and the lifting time Δt. Note that a correspondence table can also be used to define the correspondence between threshold values for the lifting time Δt and the quantity of waste fluid or the state of storage of waste fluid (a correspondence table) can be stored in the storing portion 54. Such a correlation table can also be referred to as a Look Up Table (LUT). The threshold value can be a single value or two or more values. When, for example, the lifting time Δt is equal to or greater than a threshold value that is set in advance, the evaluating portion 55 can evaluate (or "determine") that a prescribed waste fluid quantity has been reached. Additionally, a correspondence can be defined between the state wherein the waste fluid tank 41 is full and a first threshold value for the lifting time Δt, and the evaluation can be that the waste fluid tank 41 is full if the lifting time Δt measured by the measuring portion 53 is equal to or greater than the first threshold value.

Figure 7A:
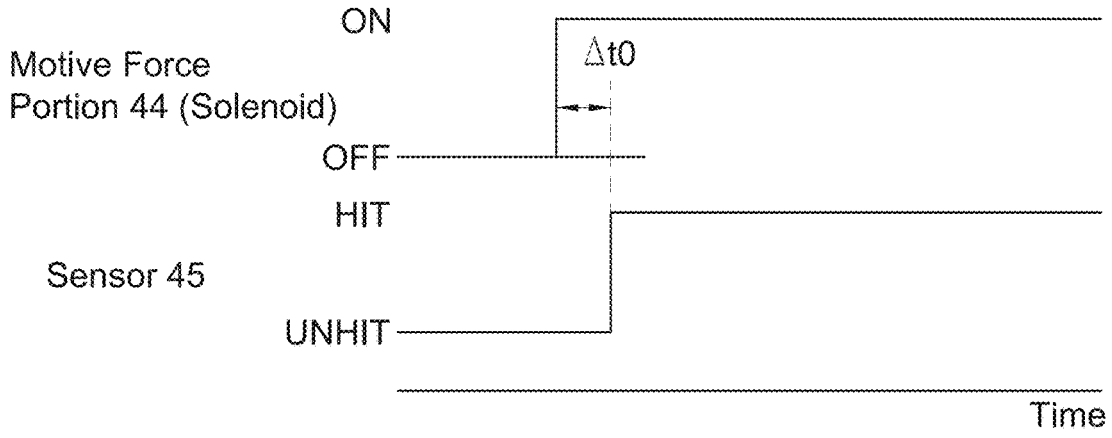
FIG. 7 (*a*) is an operation waveform for when the waste fluid tank is in the empty state.
Figure 7B:
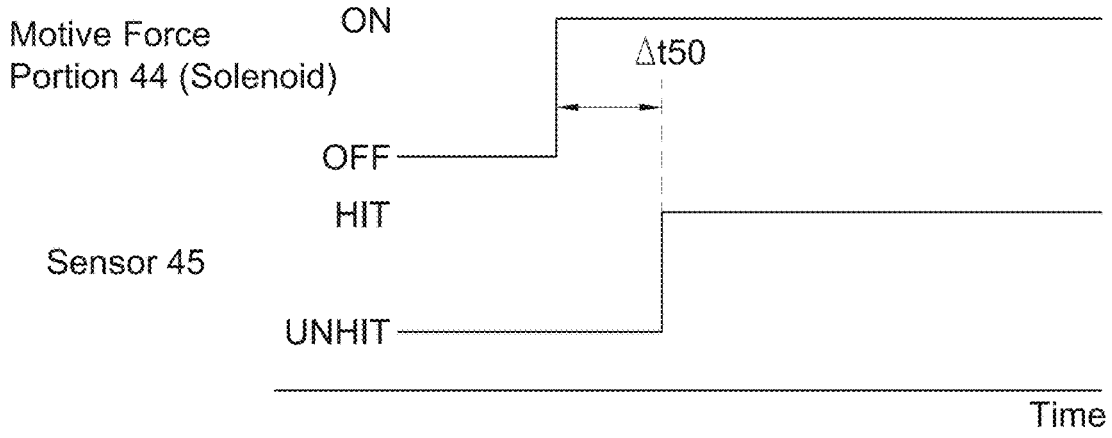
Figure 7C:
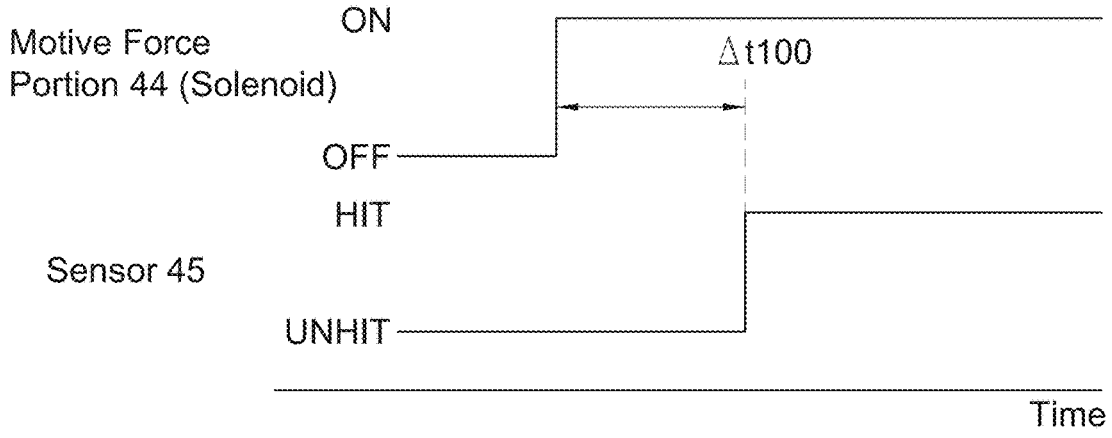

The principal for calculation of the waste fluid quantity from the lifting time Δt is explained referencing FIG. 7. FIG. 7 (*a*) is an operation waveform when the waste fluid tank 41 is in the empty state (wherein the quantity of waste fluid is 0% of the storage capacity of the waste fluid tank 41), FIG. 7 (*b*) is the operation waveform when the waste fluid quantity is 50% of the storage capacity of the waste fluid tank 41, and FIG. 7 (*c*) is the operation waveform when the waste fluid tank 41 is full (when the quantity of waste fluid is 100% of the storage capacity of the waste fluid tank 41). Here the force F with which the motive force portion 44 lifts the placement platform 42, the mass m of the placement platform 42, including the waste fluid tank 41, and the acceleration a of the upward movement of the placement platform 42 are expressed by Newton's equation of motion (the F=m a). The force F with which the motive force portion 44 lifts the placement platform 42 is independent of the quantity of waste fluid in the waste fluid tank 41, and is a constant in FIG. 7 (*a*) through (*c*). On the other hand, when the quantity of waste fluid in the waste fluid tank 41 increases, the mass m increases. That is, the mass m0 in the state wherein the waste fluid tank 41 is empty, the mass m50 in the state wherein the amount of waste fluid is 50%, and the mass m100 when the waste fluid tank 41 is full will have the relationship m0<m50<m100. From Newton's equation of motion, the mass m and the acceleration a are inversely proportional. Consequently, in order to maintain a balance of forces, the acceleration a (and therefore the velocity) will be slower with greater the quantities of waste fluid in the waste fluid tank 41. Because of this, the lifting time Δt will be longer in the sequence of Δt0<Δt50<Δt100. The quantity of waste fluid in the waste fluid tank 41 thus can be calculated from the lifting time Δt based thereon.

The notifying portion 56 is structured so as to provide notification to the user regarding the state of waste fluid storage in the waste fluid tank 41 based on the evaluation result by the evaluating portion 55. The notifying portion 56 can, for example, provide notification, to the user, of the waste fluid quantity itself, calculated by the evaluating portion 55. The notifying portion 56 can provide notification, to the user, of the corresponding state, in the correspondence table, when, for example, the lifting time Δt has reached, or exceeded, a threshold value that is set in advance. The notifying portion 56 can instead provide notification that the waste fluid tank 41 is full. The notifying portion 56 can display the waste fluid storage state through text, an illustration, or the like, on a display screen 10*d* (referencing FIG. 1) that is provided in the printer 10, for example, and/or can provide notification of the state of storage of the waste fluid through sounding a warning tone, or the like. This enables the user to identify the state of storage of waste fluid in the waste fluid tank 41, such as, for example, that the waste fluid tank 41 is full. Consequently, the user need not check the state of storage of the waste fluid in the waste fluid tank 41 each time. This results in the ability to reduce the operational burden on the user.

As described above, in the printer 10 the waste fluid tank 41 is moved, together with the placement platform 42, to a prescribed position by the motive force portion 44 of the waste fluid quantity measuring device 40. Given this, the time (lifting time Δt) required for the movement is measured. By Newton's equation of motion, the lifting time Δt is proportional to the change in the quantity of the waste fluid in the waste fluid tank 41. This makes it possible to ascertain the state of storage of waste fluid in the waste fluid tank 41 based on the measured value for the lifting time Δt. This eliminates the need to use a costly mass sensor, enabling a reduction in manufacturing costs of the waste fluid quantity measuring device 40 and the printer 10.

Additionally, a method for evaluating the state of storage of the waste fluid, using the waste fluid quantity measuring device 40, is provided. This evaluating method includes the following steps: (Step 1) a step for driving a motive force portion 44 to move the placement platform 42 from a home position P1 to a tilted position P2 with a constant force, and for measuring the movement time until moving to the tilted position P2; and (Step 2) a step for evaluating the state of storage of waste fluid in the waste fluid tank 41 from the movement time, based on Newton's equation of motion (for example, a step for calculating the quantity of waste fluid stored in the waste fluid tank 41).

In some embodiments, the printer 10 further comprises a supporting portion 43 for supporting the placement platform 42. The supporting portion 43 has a fulcrum member 43*b* that extends in the front/rear direction X. The placement platform 42 is supported on the supporting portion 43 so as to enable tilting with the fulcrum member 43*b* as the fulcrum. Through this, the placement platform 42 can be lifted efficiently through the "principle of leverage." Moreover, even if the waste fluid tank 41 has reached a high volume, the placement platform 42 can be lifted with low power through changing the location of placement of the waste fluid tank 41 (the position of the tray 42*d*) from the fulcrum member 43*b*.

In some embodiments, the supporting portion 43 further comprises a bottom wall 43*a* that is positioned below the placement platform 42, and a side wall 43*c*, extending upward from the bottom wall 43*a*, with a receiving hole 43*o* formed therein. The placement platform 42 fits tiltably into the receiving hole 43*o*, and is supported by at least the receiving hole 43*o* and the fulcrum member 43*b* at, at least, the home position P1. This enables the placement platform 42 to be tilted more stably.

In some embodiments, the placement platform 42 is structured so that, when at the tilted position P2, the top face of the placement platform 42 will contact the top end of the receiving hole 43*o*. Excessive tilting of the placement platform 42 is prevented thereby, enabling the waste fluid tank 41 to be held more stably.

In some embodiments, the motive force portion 44 is connected to the placement portion 42 at a position that is farther from the fulcrum member 43*b* than the tray 42*d*, when viewed from the direction in which the fulcrum member 43*b* extends (the front/rear direction X). This enables the placement platform 42 to be lifted more stably.

In some embodiments, the sensor 45 is located at a position that is farther from the fulcrum member 43*b* than the tray 42*d*, when viewed from the direction of extension of the fulcrum member 43*b* (the front/rear direction X). This enables the change in position of the placement platform 42 to be better detected, enabling an improvement in measurement accuracy.

In some embodiments, the structure is such that when the driving of the motive force portion 44 is stopped, the placement platform 42 will be returned automatically from the tilted position P2 to the home position P1, through its own weight. The use of gravity eliminates the need for controlling the movement from the tilted position P2 to the home position P1, enabling a simplification of the controlling portion 50.

In some embodiments, the structure is such that when the placement platform 42 is at the home position P1, the placement platform 42 will be oriented substantially horizontally. This enables the surface of the fluid in the waste fluid tank 41 to be preserved substantially horizontally except when checking the state of storage of the waste fluid in the waste fluid tank 41. This reduces the likelihood of splashing of waste fluid from the waste fluid to 41 even if the user were to bump the printer 10 in a state wherein there is a large amount of waste fluid within the waste fluid tank 41, for example.

In ink jet printer 10 has been explained above. However, the present inventions disclosed herein are not limited to the context of ink jet printers. The present inventions can also be implemented in other contexts, based on the detail disclosed in the present Specification and on the common general technical knowledge in the applicable field. The technology described in the claims includes a variety of modifications and changes to the embodiments described above. For example, portions of the embodiments described above can be combined, or replaced with other modified forms, and other modified forms can be added to the embodiments described above. Moreover, if other technologically distinctive features have not been described as being essential, these can also be removed as appropriate.

For example, while in the embodiment described above, the waste fluid quantity measuring device 40 is equipped with a photosensor 45, there is no limitation thereto. The sensor 45 can be a sensor of a non-contact type or can be a sensor of a contact type. The sensor 45 can be an angle sensor that is able to measure directly the tilt angle of the table 25, or a position sensor that is able to measure the position of the table 25, or a switch, or the like, for detecting that the table 25 has moved from the home position P1 to the tilted position P2.

Additionally, while in the embodiment described above, the structure was such that the carriage 19 of the printer 10 moves in the crosswise direction Y and the table 25 moves in the front/rear direction X, there is no limitation thereto. The carriage 19 and the table 25 move relatively, and either can move in the crosswise direction Y or the front/rear direction X. Moreover, the configuration can be such that the table 25 is located immovably, and the carriage 19 is able to move in both the crosswise direction Y and the front/rear direction X.

Further, while in the embodiment described above, the explanation was for a printer 10 of a so-called "shuttle type" (serial type) wherein an ink head 22 is mounted on a carriage 19 and printing is carried out while undergoing reciprocating motion (shuttle motion) in the crosswise direction Y, there is no limitation thereto. The technology disclosed herein can be applied similarly even to a printer of a so-called "line type" that is equipped with a line head that is the same length, or wider, than the printed object 25*a*, wherein printing is carried out with the line head in a stationary state.

Additionally, the technology disclosed herein can be applied to a variety of types of ink jet printers. For example, while, in the embodiment above, the printer 10 was equipped with an ultraviolet radiation lamp 23, the ultraviolet radiation lamp 23 is not absolutely necessary, but rather can be omitted. In this case, inks other than UV inks can be stored in the ink cartridges 21.

Figure 8:
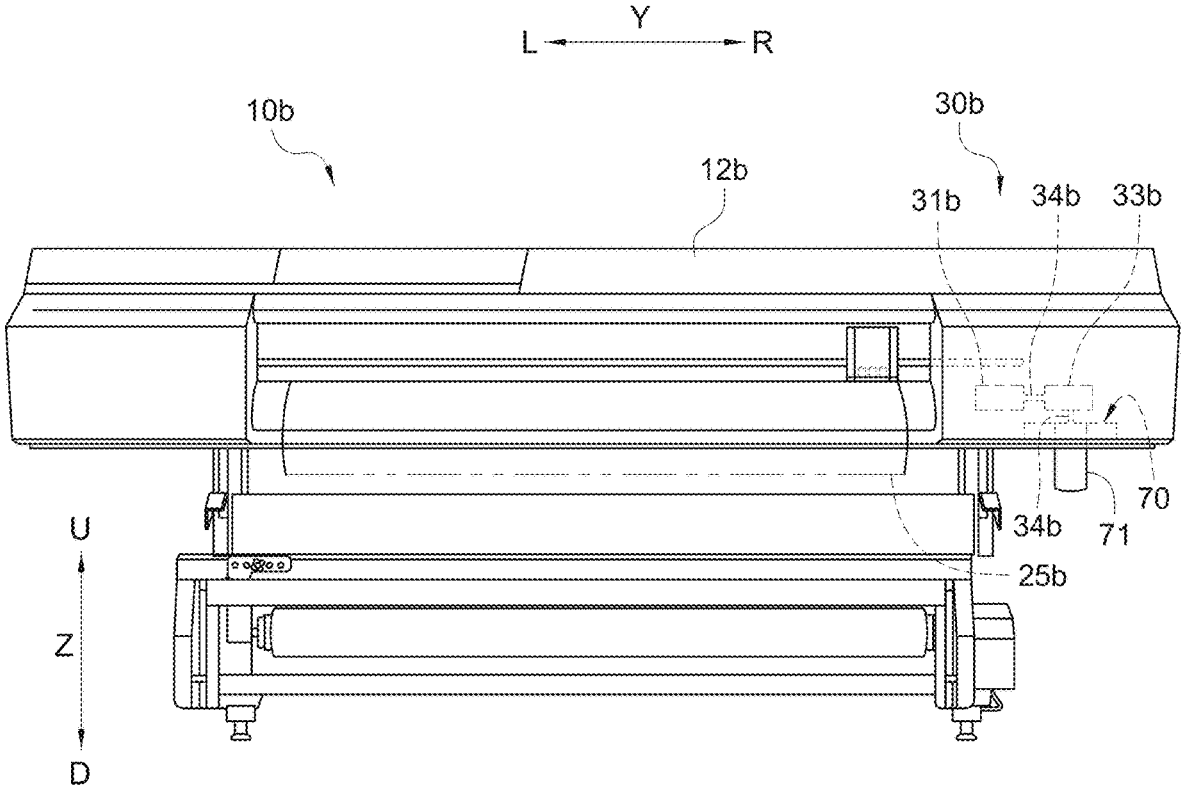
FIG. 8 is a front view of an ink jet printer according to another embodiment.

While in the embodiment described above, the printer 10 is referred to as a so-called "flatbed type," and the waste fluid tank 41 is located in the interior of the printer 10, there is no limitation thereto. FIG. 8 is a front view of a printer 10*b* according to another embodiment. The printer 10*b* is a so-called "roll-to-roll" printer. The printer 10*b* feeds a role-type printed object (for example, a roll of paper) as the printed object 25*b*. The printer 10*b* has a casing 12*b*. The cleaning device 30*b* is located in the interior of the casing 12*b*. The cleaning device 30*b* comprises a cap 31*b* that is connected to a cap moving mechanism, not shown, a suction pump 33*b*, and a waste fluid duct 34*b*. The printer 10*b* sends the waste fluid, produced through cleaning operations, and the like, through the waste fluid duct 34*b* to the waste fluid quantity measuring device 70. The waste fluid quantity measuring device 70 comprises a waste fluid tank 71, and a placement platform 72 that supports the waste fluid tank 71 through suspension, and, aside from not having the supporting portion, is similar to the waste fluid quantity measuring device 40, described above.

Figure 9:
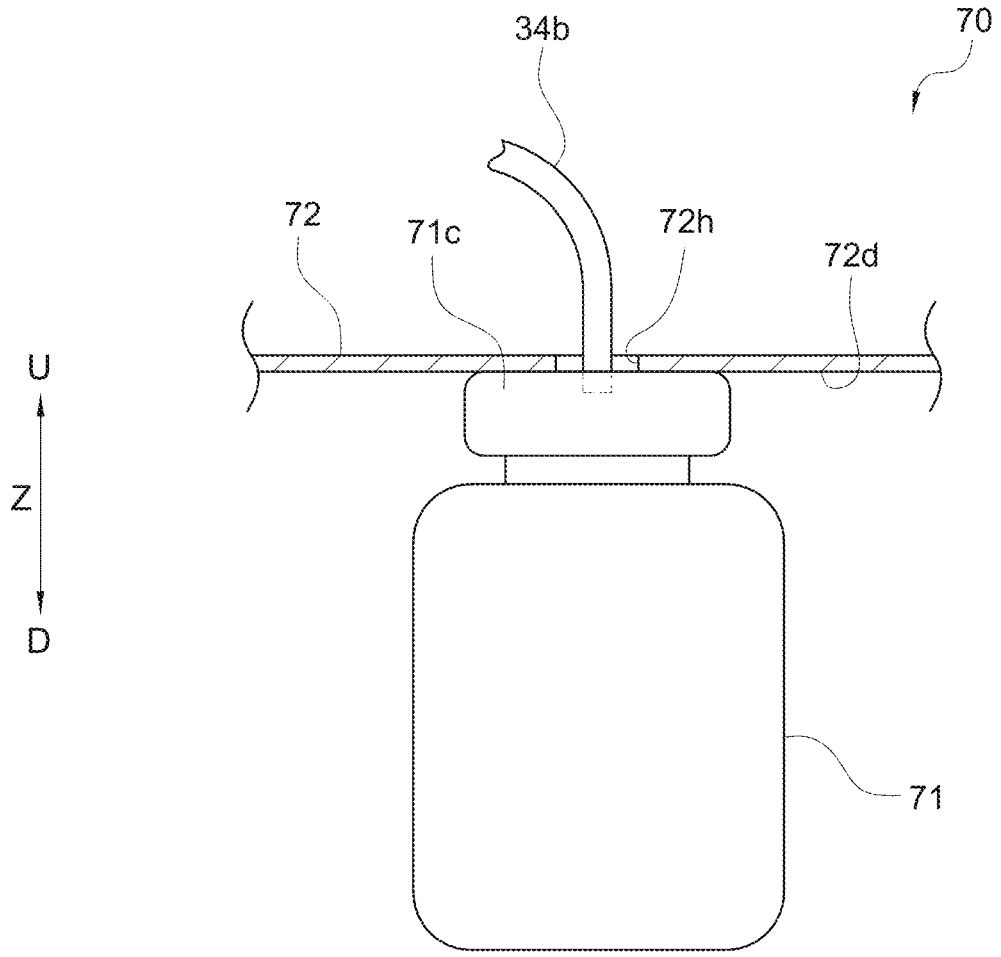
FIG. 9 is an enlarged view wherein of portions of the waste fluid quantity measuring device of FIG. 8.

FIG. 9 is an enlarged view of a portion of a waste fluid quantity measuring device 70. As illustrated in FIG. 9, in some embodiments, the placement platform 72 has a passage opening 72*h* that passes through in the vertical direction Z. The bottom end portion of the waste fluid duct 34*b* is inserted into the passage opening 72*h*. A cover member 71*c* is attached directly below the bottom face 72*d* and the passage opening 72*h* of the placement platform 72. The waste fluid tank 71 is engaged removably with the cover member 71*c*. The waste fluid tank 71 is supported by, in this example suspended from, the placement platform 72, through the cover member 71*c*. The bottom of the waste fluid tank 71 is exposed on the outside of the casing 12*b*.

Moreover, there is no limitation to the printer 10 being used independently as an independent printer, but rather can be combined with another device. For example, the printer 10 can be equipped with a cutting head for cutting the printed object 25*a*.

While, for example, the descriptions in the embodiments above used an ink jet printer as an example, the waste fluid quantity measuring device 40 can be applied to other than ink jet printers as well, and can be applied, for example, to a variety of manufacturing equipment that use ink jet techniques, electronic device manufacturing equipment, three-dimensional molding devices (so-called "3D printers"), production equipment, chemical vacuum equipment, and the like, in a broad range.

Moreover, while, in the embodiments set forth above, the liquid recovered in the waste fluid tank 41 was a waste fluid that included waste ink that was discharged from the ink heads 22, there is no limitation thereto. The liquid recovered in the waste fluid tank 41 can instead be, for example, a cleaning fluid for cleaning the nozzles 22*a* of the heads 22, and the like, a functional organic material solution, a pharmaceutical product, a resin fluid, or another liquid other than waste ink.

What is claimed is:

1. A waste fluid quantity measuring device, comprising:

a waste fluid tank for recovering a waste fluid;

a placement platform, having a placing portion for placement of the waste fluid tank, and on which the total mass of the waste fluid tank acts;

a motive force portion, connected to the placement platform, for moving at least a portion of the placement platform from a first position to a second position that is higher than the first position, with a constant force;

a sensor for measuring a position of the placement platform;

a measuring portion for driving the motive force portion to move the placement platform, and for measuring movement time for the placement platform moving from the first position to the second position, based on a measurement result by the sensor;

a storing portion for storing a correspondence between the movement time and the quantity of the waste fluid within the waste fluid tank; and an evaluating portion for evaluating a state of storage of waste fluid of the waste fluid tank from the movement time measured by the measuring portion, based on the correspondence of the storing portion.

2. The waste fluid quantity measuring device as set forth in claim 1, further comprising:

a supporting portion for supporting the placement platform, wherein:

the supporting portion has a fulcrum member that extends in a prescribed direction along a bottom face of the placement platform; and the placement platform is supported on the supporting portion so as to be able to tilt with the fulcrum member as the fulcrum.

3. The waste fluid quantity measuring device as set forth in claim 2, wherein:

the supporting portion further comprises a bottom wall that is positioned below the placement platform, and a vertical wall that extends upward from the bottom wall and in which a receiving hole is formed; and the placement platform is fitted tiltably in the receiving hole, and is supported, at least a first position, by the receiving hole and the fulcrum member.

4. The waste fluid quantity measuring device as set forth in claim 3, wherein:

the placement platform is configured so that, when at the second position, the top face of the placement platform contacts a top end of the receiving hole.

5. The waste fluid quantity measuring device as set forth in claim 2, wherein:

the motive force portion is connected to the placement platform at a position that is farther from the fulcrum member than the placing portion, when viewed from the direction of extension of the fulcrum member.

6. The waste fluid quantity measuring device as set forth in claim 2, wherein:

the sensor is located at a position that is farther from the fulcrum member than the placing portion, when viewed from the direction of extension of the fulcrum member.

7. The waste fluid quantity measuring device as set forth in claim 1, wherein:

the placement platform is configured so that, when driving of the motive force portion is stopped, the placement platform will move from the second position to the first position through the force of gravity.

8. The waste fluid quantity measuring device as set forth in claim 1, wherein:

the structure is such that the placement platform will be in a substantially horizontal orientation when the placement platform is at the first position.

9. A printer comprising:

an ink head having a nozzle for discharging ink;

a cleaning device for carrying out a cleaning operation for discharging ink from the nozzle; and a waste fluid quantity measuring device as set forth in claim 1, recovering the ink that is discharged from the cleaning device.

10. A waste fluid quantity measuring device, comprising:

a waste fluid tank;

a support platform mounted for movement between a first position and a second position, the waste fluid tank being supported on the support platform such that the total mass of the waste fluid tank is supported by the support platform, wherein the waste fluid tank is raised to a higher position when the support platform is moved from the first position to the second position;

an actuator connected to the support platform and configured to move the support platform from the first position to the second position, with a constant force;

a sensor configured to detect the support platform in the second position;

a timer configured to clock the elapsed time between actuation of the actuator and the movement of the support platform into the second position;

a memory device configured to store correlation data indicative of a correlation between elapsed time clocked by the timer and a quantity of waste fluid within the waste fluid tank; and a waste quantity determination device configured to classify the quantity of the waste fluid in the waste fluid tank based on the elapsed time clocked by the timer and the correlation data in the memory device.

11. The waste fluid quantity measuring device as set forth in claim 10, further comprising a fulcrum member extending along a bottom surface of the support platform and defining a tilt axis of the movement of the support platform between the first and second positions.

12. The waste fluid quantity measuring device as set forth in claim 11, further comprising a bottom wall positioned below fulcrum member, a vertical wall extending upwardly from the bottom wall, and a receiving hole formed in the vertical wall, wherein a portion of the support platform extends through the receiving hole, and is supported, at least the first position, by the receiving hole and the fulcrum member.

13. The waste fluid quantity measuring device as set forth in claim 12, wherein the support platform is configured so that, when in the second position, a top face of the support platform contacts a top end of the receiving hole.

14. The waste fluid quantity measuring device as set forth in claim 11 wherein the actuator is connected to the support platform at a position that is farther from the fulcrum member than the waste fluid tank.

15. The waste fluid quantity measuring device as set forth in claim 11, wherein the sensor is located at a position that is farther from the fulcrum member than the waste fluid tank.

16. The waste fluid quantity measuring device as set forth in claim 10, wherein support platform is mounted such that when the actuator is deactivated, the support platform will move from the second position to the first position through the force of gravity.

17. The waste fluid quantity measuring device as set forth in claim 10, wherein the support platform is mounted to be substantially horizontal orientation when the support platform is in the first position.

18. The waste fluid quantity measuring device as set forth in claim 10, further comprising an output device configured to output an indication of the classification of the quantity of the waste fluid in the waste fluid tank.

19. The waste fluid quantity measuring device as set forth in claim 10, in combination with an ink jet printer comprising an ink head having at least one nozzle configured to discharge ink for printing on media, and a waste fluid passage configured to guide ink from the nozzle to the waste fluid tank.

* * * * *